US005209494A

United States Patent [19]

Spector

[11] Patent Number: 5,209,494

[45] Date of Patent: May 11, 1993

[54] BIOFEEDBACK GAME

[76] Inventor: Donald Spector, 380 Mountain Rd., Union City, N.J. 07087

[21] Appl. No.: 840,023

[22] Filed: Feb. 24, 1992

[51] Int. Cl.[5] ..... A63F 9/24

[52] U.S. Cl. ..... 273/460; 273/431

[58] Field of Search ..... 273/460, 236, 237, 429, 273/430, 431, 454; 128/734, 736

[56] References Cited

U.S. PATENT DOCUMENTS

| | | | |
|---|---|---|---|
| 3,648,686 | 3/1972 | Payne | 273/460 |
| 3,727,604 | 4/1973 | Sidwell et al. | 128/734 |
| 3,841,316 | 10/1974 | Meyer | 273/460 |
| 4,088,125 | 5/1978 | Forgione et al. | 128/734 |
| 4,246,906 | 1/1981 | Winberg et al. | 128/736 |
| 4,358,118 | 11/1982 | Plapp | 273/460 |
| 4,632,126 | 12/1986 | Aguilar | 273/460 |
| 4,812,126 | 3/1989 | Gilliksen | 273/460 |
| 4,819,656 | 4/1989 | Spector | 128/736 |
| 4,949,726 | 8/1990 | Hartzell et al. | 273/460 |
| 5,021,768 | 6/1991 | Kishida et al. | 273/460 |

*Primary Examiner*—Jessica J. Harrison

*Attorney, Agent, or Firm*—Michael Ebert

[57] ABSTRACT

A biofeedback game in which a target player sits on a "hot seat" where he is assailed by provocative questions or statements put to him by an inquisitor player, calculated to induce stress by embarrassing or otherwise upsetting the target player and thereby causing him "to lose his cool." The target player is coupled by means of a temperature sensor attached to one of his fingertips to a biofeedback unit whose indicator at the start of play is set to a base level representing the target player's initial state of stress. Should the target player who views the indicator while his fingertip temperature is being monitored and is therefore within the feedback loop, fail to control his reaction to a provocative question or statement, the resultant indication will deviate from the base level to a degree reflecting his loss of cool. The provocative question put to the target player must fall within a subject matter category, such as Sex, Education, or Hygiene, appearing on a category card drawn by the inquisitor player from a deck of such cards. The outcome of the game depends on the skill of the inquisitor player to frame provocative questions that lie within the selected category, as offset by the ability of the target player, by way of biofeedback regulation, to maintain his cool under pressure.

9 Claims, 1 Drawing Sheet

Fig.1
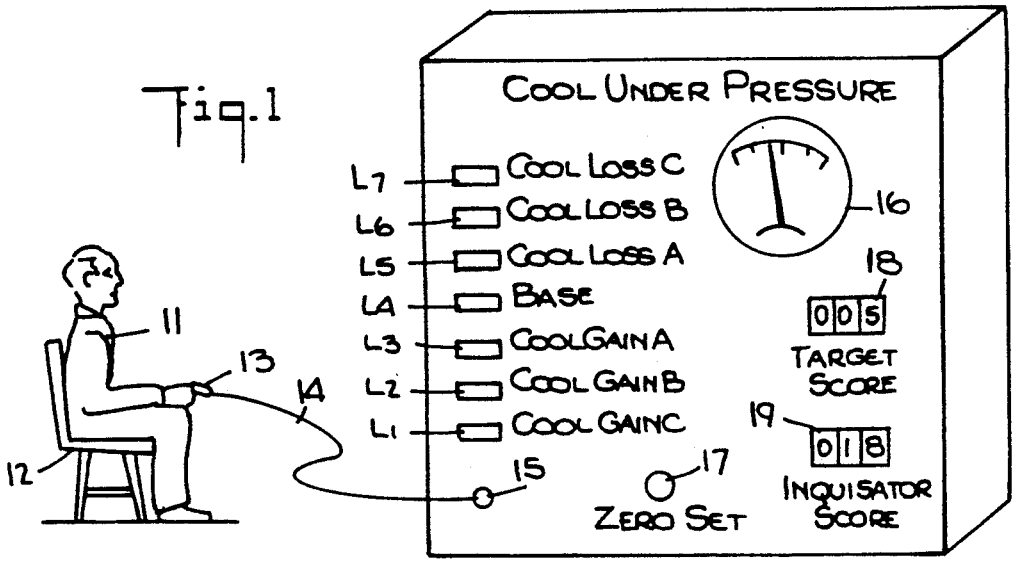
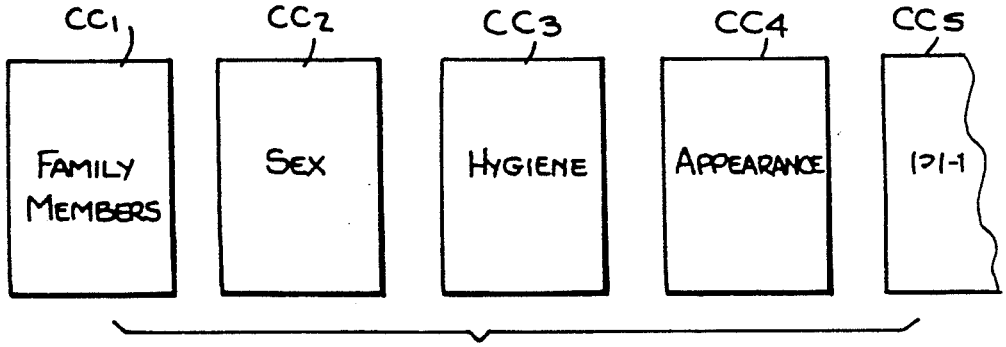
Fig.2
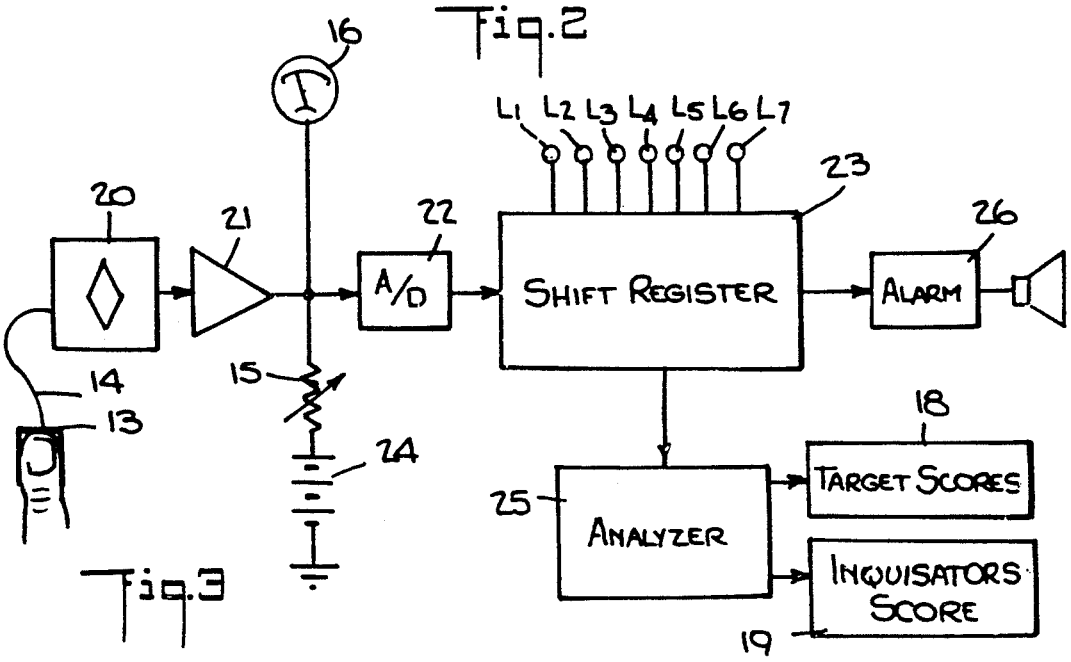
Fig.3

BIOFEEDBACK GAME

BACKGROUND OF INVENTION

1. Field of Invention

This invention relates generally to biofeedback systems which act to monitor an involuntary physiological function of an individual and indicate the individual's state of stress, making it possible for the individual to exercise control over the function being monitored, and more particularly to a cool-under-pressure biofeedback game in which an individual who sits on a "hot seat" and assumes the role of the target player is assailed by provocative questions put to him by an inquisitor player which are calculated to induce stress, the outcome of the game depending on the skill of the inquisitor player to frame provocative questions that lie within a selected subject matter category, as offset by the ability of the target player to resist provocation and to maintain his cool.

2. Status of the Art

An individual's ability to mentally control certain of his physiological functions such as body temperature or blood pressure is known as self-regulation. But with the exception of those committed to transcendental meditation, self-regulation techniques have not been widely practiced in Western society, possibly because many disorders induced or aggravated by stress which lend themselves to alleviation by self-regulation can more readily be treated by medication. Thus a muscle contraction or tension headache as well as migraine, a vascular headache that is more painful than a tension headache, can, to some degree, be relieved by aspirin and other drugs. Such medication does not do away with stress factors responsible for the headache but serves only to moderate the symptoms. Moreover, aspirin and other drugs, when taken frequently and in large doses, often have deleterious side effects.

In recent years, biofeedback techniques have been developed which represent a more effective form of self-regulation In biofeedback, an involuntary or unconscious physiologic process, such as the heart beat or the brain wave, is made perceptible to the senses, thereby making it possible for the individual to manipulate the process by conscious mental control.

Stress is expressed in many ways, and may be manifested by a headache or by high blood pressure. Of overriding importance in stress therapy is learning to relax and thereby reduce tension and its physiological consequences. With biofeedback, one is able to achieve mental and physical relaxation by being fed back information regarding an unconscious physiological process. This information is derived by means of a non-invasive sensor which measures peripheral skin temperature or skin resistance, heart rate, blood pressure, pulse rate, and some other process variables.

Thus a signal from an electromyograph is indicative of varying levels of muscular activity; the higher the signal amplitude, the greater the amount of muscular tension. A high level of muscular tension reflects a high degree of stress, giving rise to tension headaches, facial pain and tics, and other stress-related illnesses. By means of biofeedback, one can monitor a specific physiologic process and derive therefrom a visible or audible signal indicative of the process. In this way, the user can manipulate the process being monitored by learning to control the signal it yields. By biofeedback one can reduce muscle tension, slow down a rapid heart rate, regulate blood flow to alleviate circulatory problems and, in general, relax the nervous system.

The efficacy of biofeedback is well established. Thus in the article by Sidney Leber, M. D., "Biofeedback in Clinical Psychiatric Practice" appearing in Psychiatric Opinion of October 1979, the author states that patients previously dependent on medication for migraine and other stress-related conditions which are responsive to feedback "can reduce their medications to a line of last defense rather than continue to routinely ingest medications as a way of life."

In my prior Spector U.S. Pat. No. 4,819,656, the entire disclosure of which is incorporated herein by reference, there is disclosed a biofeedback therapy system that includes a sensor continuously to monitor a physiologic function of the individual in the course of a training run to produce a signal representing the individual's prevailing level of stress. The system includes a scale responsive to said signal to visually indicate the level of stress, making it possible for the individual mentally regulate the function being monitored.

The individual being monitored during the course of the training run is subjected to a series of startling and disquieting stress-inducing sound stimuli which differ from each other and appear at random intervals, and are therefore unexpected, to induce internal stress in the individual in the course of the run.

These stress-inducing sounds are produced by a tape recording on which are recorded at intermittent times startling sounds, such as that of a police siren or a loud pistol shot. The listener, who is coupled to the feedback system and hears and reacts to these sounds, seeks to exercise control of his reaction.

In a cool-under-pressure biofeedback game in accordance with the invention, an individual sitting on a "hot seat" is placed within a biofeedback loop so that he sees indicated on a visual display the physiological function being monitored over which he seeks to exercise control when he is subjected to stress-inducing sounds. However, these sounds are not, as in my prior patent, pre-recorded sounds of a police siren, a human scream or a loud pistol shot, but take the form of improvised questions or statements put to him by an opposing player.

The questions are so framed as to be highly provocative, and they evoke in the individual on the hot seat a stress-inducing reaction causing him to lose his cool. This reaction to questions which are personal in nature is usually more pronounced than one induced by impersonal sounds. Thus almost all people, regardless of personal differences, react to the sounds of a fire alarm or that of a ringing telephone. However, the reaction of an individual to a question that touches on him personally depends, of course, on the nature of the question, and in some instances, a question which strikes on a sensitive nerve may evoke a very strong reaction. For example, when a person under oath is on a witness stand and is asked under cross-examination whether in his previous testimony his lied about his whereabouts on a certain day, his reaction could then be very strong had he in fact lied, but mild had he not.

Also of prior interest are the patents to Sidwell et al., U.S. Pat. No. 3,727,604, to Generales, Jr., U.S. Pat. No. 4,166,452, to Forgione et al., U.S. Pat. No. 4,088,125, and to Winberg et al., U.S. Pat. No. 4,246,906.

SUMMARY OF INVENTION

The main object of this invention is to provide a cool-under-pressure biofeedback game in which an individual who assumes the role of a target player sitting on a "hot seat" where he is linked to a biofeedback unit that monitors and indicates his fingertip temperature or any other involuntary physiological variable, is assailed by stress-inducing provocative questions by an inquisitor player, the degree to which the target player is able to exercise control over his reaction and thereby maintain his cool determining the outcome of the game.

More particularly, an object of this invention is to provide a game of the above-noted type in which the inquisitor player must frame provocative questions that fall within a subject matter category, such as "Personal Appearance" or "Hygiene," printed on a category card drawn by the inquisitor from a deck of such cards.

A significant feature of the invention is that it tests the skill of an inquisitor player to frame questions that take into account the personal characteristics or background of the target player, and in this context are calculated to be highly provocative. Thus the inquisitor player assumes the role of a lawyer who in cross-examining a hostile witness with a view to discrediting him, seeks to cause this witness, who in effect is sitting on a hot seat, to lose his cool under pressure.

Also an object of this invention is to provide in a biofeedback unit that monitors an involuntary physiological variable of the target player and indicates the degree to which stress is induced by provocative questions put to him by the inquisitor player, means to score the ability of the target player to exercise control over his reaction to these questions as well as to score the inquisitor player's skill in framing provocative questions.

An important advantage of a biofeedback game in accordance with the invention is that it is not only highly entertaining, but also has therapeutic value, for it enhances the ability of a target player to exercise control over induced stress, and in this regard it affords the same benefits as a conventional biofeedback therapy system which lacks entertainment value.

Briefly stated, these objects are attained in a biofeedback game in which a target player sits on a "hot seat" where he is assailed by provocative questions or statements put to him by an inquisitor player, calculated to induce stress by embarrassing or otherwise upsetting the target player and thereby causing him "to lose his cool." The target player is coupled by means of a temperature sensor attached to one of his fingertips to a biofeedback unit whose indicator at the start of play is set to a base level representing the target player's initial state of stress. Should the target player who views the indicator while his fingertip temperature is being monitored and is therefore within the feedback loop, fail to control his reaction to a provocative question or statement, the resultant indication will deviate from the base level to a degree reflecting his loss of cool. The provocative question put to the target player must fall within a subject matter category, such as Sex, Education, or Hygiene, appearing on a category card drawn by the inquisitor player from a deck of such cards. The outcome of the game depends on the skill of the inquisitor player to frame provocative questions that lie within the selected category, as offset by the ability of the target player, by way of biofeedback regulation, to maintain his cool under pressure.

BRIEF DESCRIPTION OF DRAWINGS

For a better understanding of the invention as well as other objects and further features thereof, reference is made to the following detailed description to be read in conjunction with the accompanying drawings, wherein:

FIG. 1 illustrates the biofeedback unit included in a cool-under-pressure biofeedback game in accordance with the invention;

FIG. 2 shows some of the subject matter category cards included in a deck of such cards used in playing the game; and FIG. 3 is a block diagram of the circuit of the biofeedback unit.

DESCRIPTION OF INVENTION

The Biofeedback Game

Referring now to FIGS. 1 and 2, there is shown a cool-under-pressure biofeedback game in accordance with the invention, the game making use of a biofeedback unit, generally identified by reference numeral 10, a deck of subject matter cards, such as cards $CC_1$, $CC_2$, $CC_3$ and $CC_4$.

Unit 10 functions to monitor an involuntary physiological variable of a player 11, who in the game assumes the role of a target player sitting on a chair 12. This chair is referred to as the "hot seat" in that the object of the game is to try to embarrass or otherwise upset the target player so as to cause him "to lose his cool."

The physiological variable which is preferably monitored is fingertip temperature, and to this end attached to a fingertip of target player 11 is a temperature-sensitive sensor 13, such as a thermistor, to sense the temperature of the player's fingertip. The invention is not limited to sensing fingertip temperature, for other physiological variables such as heart pulse rate may be monitored and indicated. Sensor 13 is connected to a cable 14 which terminates in a plug plugged into the input socket 15 of the biofeedback unit 10.

Body temperature is determined by the relationship existing between the amount of heat that is internally generated, this depending on basal metabolism, and the amount of heat escaping from the body. Additional heat is produced as a result of muscular activity, this being dissipated by an increase in radiation, conduction or evaporation from the skin surface. When the interior temperature of the body is said to be normally at 98.6° F., actually in the course of each 24-hour day, the body temperature rises and falls with respect to this value within a 1.8° F. range.

When an individual becomes angry or otherwise emotionally aroused, he usually becomes red in the face or flushed. And if one were to then measure the temperature at the surface of the cheek, it would indicate a rise in temperature above normal.

When sensing peripheral skin temperature, say, at a fingertip, a low temperature is then indicative of a high level of stress, for under stress conditions, the extremities grow cooler, not warmer, whereas the skin temperature on the face may then rise. Hence when the sensed skin temperature is the yardstick to a stress condition, one must bear in mind how to interpret changes in this temperature.

Monitoring of a physiological variable is important to researchers and others who wish to learn to exercise control over processes which are indicated autonomically or reflexively. Since monitoring is indispensable to those desiring to achieve relaxation and a reduction in stress, such relaxation is inversely proportional to the sympathetic branch of the autonomic nervous system.

The temperature of an extremity, such as a fingertip, is proportional to the rate of blood flow through the extremity. The autonomic nervous system controls the rate of blood flow circulating through all parts of the body. Sympathetic stimulation reduces the blood flow to the extremities. Hence fingertip temperature varies inversely with the sympathetic branch of the autonomic nervous system. And monitoring fingertip temperature to indicate the rise and fall of this temperature reveals the state of the sympathetic nervous system.

In a biofeedback unit 10, it is the fingertip temperature of the target player that is being monitored. When, therefore, stress is induced in the target player as a result of a provocative question or statement put to him by an inquisitor player, and he is then unable to exercise control over his reaction, his fingertip will become cooler; whereas if he is able to exercise control, his fingertip temperature will remain unchanged from its initial temperature level at the start of play or become warmer, depending on the extent to which he exercises control over his reaction.

The loss of cool and fingertip temperature are inversely related; for the greater the target player's loss of cool, the cooler is his fingertip temperature. This is seemingly contradictory, but it is what actually takes place.

Biofeedback unit 10 is provided on its front panel with an analog meter 16 whose pointer indicates along a scale the fingertip temperature being monitored. Also mounted on the front panel is a step-scale indicator constituted by a series of LED's $L_1$ to $L_7$ which are selectively activated as a function of fingertip temperature. The arrangement is such that at the start of play, the then existing fingertip temperature, prior to provocation of the target player by an inquisitor player, results in activation of LED $L_4$ which is at the midpoint in the LED series and represents the BASE condition at the outset of play.

When the target player on the hot seat is assailed by a provocative question or statement put to him by an inquisitor player and is thereby put under pressure, if he is then unable to exercise control over his reaction, he will "lose his cool." This loss of cool is reflected in a rise in fingertip temperature.

No two individuals in the role of target player will exhibit the same initial level of stress at the start of play, just as no two individuals using a feedback system in which their level of stress is monitored and indicated will at the outset of a run be at the same stress level. Hence it is necessary, as it were, to zero set biofeedback unit 10 to a base level by means of a zero-set control knob 17. This knob is adjusted so that at the outset of a game in which a target player is on the hot seat awaiting questions from an inquisitor player, the pointer of meter 16 is at its midpoint and the LED $L_4$ is then activated to indicate a BASE state; that is, the stress state of the target player, whether low or high, at the outset of play.

When an inquisitor player then puts a stress-inducing question or statement to the target player, the target player who is in the feedback loop sees his reaction to this provocation on both analog meter 16 and on the step scale LED indicators. If the provoked target player is unable to exercise control over his reaction, then his fingertip temperature will be reduced to the extent to which the player has lost his cool.

Thus if the loss of cool is mild because the question put to the target player elicits only a relatively small reduction in fingertip temperature, then LED $L_5$ will be activated to indicate a COOL LOSS A condition. But if the loss of cool is moderate, LED $L_6$ will be activated to indicate COOL LOSS B. And if the loss of cool is pronounced, then LED $L_7$ will be activated to indicate a COOL LOSS C state.

On the other hand, the target player, as a result of prior training with a biofeedback system or because of his ability to stay cool under pressure, may be able, when provoked, to exercise control over his reaction to a degree where his stress is more or less reduced below the BASE state indicated by LED $L_4$.

Thus if in response to a provocation the target player is able to slightly reduce his stress below the BASE state, LED $L_3$ will be activated to indicate a COOL GAIN A state. Should the target player, by exercising control over his reaction, effect a somewhat greater reduction in stress, then LED $L_2$ will be activated to indicate COOL GAIN B. And should he succeed in effecting an even greater reduction in stress, then LED $L_1$ will be activated to indicate a COOL GAIN C state.

In this way, the target player on the hot seat sees an indication of his level of stress as it is being monitored both on the analog meter 16 and on the step scale LED indicators $L_1$ to $L_7$, and he strives to exercise control, as best he can, over his reaction to provocation by the inquisitor player.

The scoring of the game depends on the ability of the target player, when assaulted by stress-inducing question by the inquisitor player, to exercise control of his reaction, as opposed to the skill of the inquisitor player to frame questions that will provoke a strong reaction when put to the target player on the hot seat. There is a chance factor in this game, for the inquisitor player must frame his questions so that they fall within the subject matter of the category of the card he has drawn. Hence if he draws a category such as EDUCATION, he may, within the limits of this category and based on his knowledge of the target player's background, be able to ask highly embarrassing questions, such as "Is it true that you cheated on your final exam in math at Cornell?" Or "Did you flunk out of Harvard Law School?" But if the category selected is "Family Members," the inquisitor player may not be able to frame questions that are upsetting to the target player.

Two digital scoring registers are provided which are linked to the LED step scale indicators $L_1$ to $L_7$ by an analyzer. One scoring register is a target score register 18, the other being an inquisitor score register 19.

The scoring arrangement is such that if in reaction to a question put to the target player by an inquisitor player, the target player loses his cool, then the inquisitor player scores points to the degree to which cool is lost. If, for example, in reaction to a given question, the LOSS OF COOL A indicator is activated, then the inquisitor player gains one point. But if the LOSS OF COOL B indicator is activated, the gain is two points. And if the LOSS OF COOL C indicator is activated, then the inquisitor player gains three points. These points are accumulated in register 19 which, by way of example, shows that 18 points have been earned by the inquisitor after having put, say, five provocative questions to the target player.

But if in reaction to the same five questions the target player has succeeded as to one of more of these questions in exercising control so as to effect a gain in cool, this will be scored on target score register 18. The target player will earn one point each time he exercises control to activate the COOL GAIN A indicator, two points when COOL GAIN B is activated, and three points when COOL GAIN C is activated.

The questions, which may be in rhetorical form or statements, put to the target player by an inquisitor player, or by several inquisitor players, depending on how many players participate in the game, must all lie within a subject matter category that appears in a category card drawn by the inquisitor player from a deck of such cards.

By way of example, in FIG. 2, the subject matter on category card $CC_1$ is FAMILY MEMBERS, that on card $CC_2$ is SEX, that on card $CC_3$ is HYGIENE, and that on $CC_4$ is APPEARANCE.

If, therefore, the category selected is APPEARANCE, and the target player is a woman known to be vain about her elaborately groomed coiffure, the inquisitor player can ask, "Why are you wearing a wig," and thereby get a rise out of the target player that she may find difficult to control, even though she knows that she is being deliberately insulted. And if the selected category is HYGIENE and the target player is known to be meticulous, the inquisitor player could provoke a reaction by asking "Have you bathed today, and if so, what is that foul odor I smell?"

It is not necessary that the inquisitor player know anything about the target player other than what is immediately apparent. That is, one can see that the target player is a man or woman of a certain age, is fat or thin, good looking or plain, and then on this basis, frame questions which are likely to get a rise out of the target player. It is not merely the question itself that may provoke the target player, for the suggestive or insulting manner in which it is delivered is also a factor. This permits the inquisitor player to be as theatrical as possible or as deliberately offensive as a cross-examining attorney.

Again, the aim of the game is to cause the target player on the hot seat to lose his cool, and there are no restraints on the inquisitor player other than that his attack on the target player must be in the form of verbal questions that fall within a selected subject matter category.

Because the game involves an interaction on a highly personal level between a target player and one or more inquisitor players and calls upon the latter to work up, as best he can, those questions which will cause the target player to lose his cool, the game is not repetitious in nature but has sustained play and entertainment value. But because the game puts the player in the hot seat in a feedback loop which rewards the player who succeeds in exercising control when subjected to provocation that can be, if not embarrassing, at least highly insulting, the game is useful in biofeedback therapy whose aim is to teach the patient how to relieve stress.

The Biofeedback Unit

Referring now to FIG. 3, the circuit of biofeedback unit 10 is shown in block diagram. It will be seen that sensor 13, which is a temperature-sensitive device, such as a thermistor, is attached to a fingertip F of the target player and is coupled by cable 14 to a bridge circuit 20 whose analog output voltage depends on the resistance of the thermistor which is a function of fingertip temperature, the lower this temperature the greater the stress condition of the target player being monitored.

The fingertip temperature varies inversely with stress; hence the cooler the finger, the greater the stress. The arrangement is such that the lower the fingertip temperature, the greater is the analog voltage output of bridge circuit 20. Hence this voltage is directly proportional to the stress condition being monitored.

This analog voltage is applied to an amplifier 21 whose output is fed to an analog-to-digital converter 22. Converter 22 yields pulses whose count is proportional to the analog voltage and therefore to the level of stress being monitored. Thus a low level of stress will produce a low pulse count, and a high level, a high pulse count.

The pulses from the A/D converter 22 are applied to an integrated circuit shift register 23 which is resettable. The successive stages of the shift register are coupled to the series of LED indicators $L_1$ to $L_7$. The arrangement is such that when a predetermined count of pulses, say, 10 pulses, are fed into this shift register, LED $L_1$ is activated. When the count reaches 20 pulses, LED $L_2$ is then activated, and so on, until LED $L_3$ is activated, this indicating the highest count of incoming pulses and therefore the greatest loss of cool.

In practice, one may include in the biofeedback unit an alarm circuit 26 producing an explosive sound only when the target player exhibits the greatest loss of cool and therefore, as it were, has blown his stack.

LED $L_4$ must be activated at the outset of the game when the target player is not yet being provoked and exhibits his base level of stress. This is accomplished by the zero-set control 15 which is a variable resistor in series with a battery 24 that serves to apply to the input of the A/D converter 22 a reference voltage which is combined with the voltage yielded by bridge 20 to produce a pulse count that will activate the BASE state LED $L_4$. This adjustment must be made for each target player when he takes the hot seat, for no two players exhibit the same base level of stress.

The voltage applied to A/D converter 22 rises above the value producing a BASE level state to the extent that the target player, when provoked, loses his cool, in which event the voltage goes up to successively activate COOL LOSS LED indicators $L_5$, $L_6$ and $L_7$, depending on the degree of the loss. And when the voltage applied to A/D converter 22 falls below the BASE level to the extent that the target player, when provoked, exercises control over his reaction, then the voltage goes down to successively activate COOL GAIN LED indicators $L_3$, $L_2$ and $L_2$, depending on the extent of cool gain.

In order to operate target score register 18 and inquisitor score register 19, the reaction of the target player for each provocative question is analyzed by an analyzer 25 coupled to shift register 23. Thus if the reaction results in activation of the COOL LOSS A indicator, then the analyzer will give one point to the inquisitor score register 19. But if it results in activation of the COOL LOSS B indicator, then two points will be given to the inquisitor score indicator, three points being given when COOL LOSS C is activated.

But if the reaction to a provocative question causes the target subject to so exercise control over his stress as to gain in cool, then, one, two or three points will be given to the target score register 18, depending on whether the COOL GAIN A, B or C indicator is activated.

The analog meter 16 is connected to the analog voltage input of the A/D converter 22 so that when zero set register 15 is adjusted to provide a voltage representing the BASE stress condition of the player on the hot seat, this is indicated when the pointer of meter 16 is at mid scale.

While there has been shown and described a preferred embodiment of a cool-under-pressure biofeedback game in accordance with the invention, it will be appreciated that many changes and modifications may be made therein without, however, departing from the essential spirit thereof.

In a simplied, low-cost version of the biofeedback unit, one may dispense with an analog meter and also with the series of LED indicators to indicate the extent to which the target player, in reacting to a question put to him by an inquisitor player, more or less loses his cool or gains in cool. Instead, use may be made of a liquid-crystal voltage-responsive indicator whose color changes as a function of the applied voltage.

Thus at the base level, the indicator color could be yellow, and to the extent the target player loses his cool, the color would change to deepening shades of red. And to the extent he gains in cool, the color would change to deepening shades of green.

I claim:

1. A cool-under-pressure biofeedback game in which a target player is assailed by questions put to him by an inquisitor player calculated to induce stress by embarrassing or otherwise upsetting the target player and causing him to lose his cool, said game comprising:

(a) a biofeedback unit coupled to the target player to monitor an involuntary psychological function and to indicate the target player's state of stress at the start of play;

(b) means to present to the inquisitor player a subject matter category requiring that any question he puts to the target player lie within this category; and (c) zero setting means included in the unit to establish a base level reflecting the initial state of stress of the target player at the start of play and indicating means to indicate the base level and degree to which the target player's stress in reaction to the question deviates in one direction from the base level should the target player be unable to exercise control over his reaction and in another direction should the target player succeed in exercising such control, said unit including an analyzer to measure the reaction of the target player to a series of questions put to him by the inquisitor player to determine, as to each of these questions, the degree to which the target player has succeeded in exercising control over his reaction thereto or has failed to exercise control, the analyzer including means for awarding score points to the target player whose number depends on his degree of success and means for awarding score points to the inquisitor player whose number depends on the target player's degree of failure, the total number of points scored by the target player relative to the number scored by the inquisitor player in response to said series of questions determining the outcome of the game.

2. A game as set forth in claim 1, wherein said unit is coupled to the target player by a temperature sensor attached to a fingertip of this player to provide an output which is a function of the fingertip temperature and therefore of the stress being experienced by this player.

3. A game as set forth in claim 2, wherein said sensor is a thermistor that is included in a bridge circuit arranged to produce an analog voltage that is proportional to the target player's level of stress.

4. A game as set forth in claim 3, wherein said analog voltage is converted by an analog-to-digital converter to produce pulses whose count depends on said level of stress.

5. A game as set forth in claim 4, wherein said indicating means includes a series of LED indicators, one of which indicates said base level, and means to successively activate the indicators in one direction as the pulse count increases from said base level to one representing high stress, said indicators being successively activated in the opposite direction as the pulse count decreases from the base level to one representing low stress.

6. A game as set forth in claim 1, further including a target register to score the degree to which a target player is able to exercise control over his reaction to a set of provocative questions put to him by the inquisitor player.

7. A game as set forth in claim 6, further including an inquisitor register to score in favor of the inquisitor player the degree to which the target player is unable to exercise control over his reaction to said set of questions.

8. A game as set forth in claim 1, wherein said means to present the inquisitor player with a subject matter category are constituted by a deck of cards, each having a different category printed thereon.

9. A game as set forth in claim 1, further including a target player score register and an inquisitor player score register coupled to the analyzer to indicate their respective scores.

* * * * *